US006729044B2

(12) United States Patent
Vello

(10) Patent No.: US 6,729,044 B2
(45) Date of Patent: May 4, 2004

(54) VENTILATED WALKING SHOE

(76) Inventor: Francesco Vello, Via Montello, 14, 31040 Volpago del Montello (IT)

( * ) Notice: Subject to any disclaimer, the term of this patent is extended or adjusted under 35 U.S.C. 154(b) by 41 days.

(21) Appl. No.: 10/262,775

(22) Filed: Oct. 2, 2002

(65) Prior Publication Data

US 2003/0084591 A1 May 8, 2003

(30) Foreign Application Priority Data

Oct. 3, 2001 (IT) ..... VI2001A0206

(51) Int. Cl.[7] ..... A43B 7/06; A43B 7/08; A43B 13/12

(52) U.S. Cl. ..... 36/3 B; 36/30 R; 36/31; 36/3 R

(58) Field of Search ..... 36/3 B, 103, 3 R, 36/28, 30 R, 31

(56) References Cited

U.S. PATENT DOCUMENTS

| | | | | | |
|---|---|---|---|---|---|
| 1,587,377 | A | * | 6/1926 | Grosjean | 36/30 R |
| 1,890,433 | A | * | 12/1932 | Cohen | 36/3 B |
| 2,720,041 | A | * | 10/1955 | Kajtar | 36/3 B |
| 3,050,875 | A | * | 8/1962 | Robbins | 36/3 B |
| 4,468,869 | A | * | 9/1984 | Fukuoka | 36/3 R |
| 4,693,021 | A | * | 9/1987 | Mazzarolo | 36/3 R |
| 4,771,555 | A | * | 9/1988 | Ohashi | 36/3 R |
| 5,357,689 | A | * | 10/1994 | Awai | 36/3 R |
| 5,815,949 | A | * | 10/1998 | Sessa | 36/3 B |
| 5,983,524 | A | * | 11/1999 | Polegato | 36/3 R |
| 6,581,303 | B1 | * | 6/2003 | Tuan | 36/3 B |
| 6,581,305 | B2 | * | 6/2003 | Ho | 36/3 B |
| 6,655,048 | B2 | * | 12/2003 | Moretti | 36/3 R |

FOREIGN PATENT DOCUMENTS

| | | | |
|---|---|---|---|
| EP | 0479183 | 4/1992 | |
| EP | o695514 A1 * | 7/1995 | ..... A43B/13/18 |
| EP | 1118280 | 7/2001 | |
| WO | WO 97/14326 | 4/1997 | |
| WO | WO 01/10257 | 2/2001 | |

* cited by examiner

*Primary Examiner*—Anthony D. Stashick
(74) *Attorney, Agent, or Firm*—R. Neil Sudol; Henry D. Coleman; Willliam J. Sapone

(57) ABSTRACT

A ventilated walking shoe comprising a mid-sole, under the upper. The mid-sole is constituted by a felt of natural fibers and is surmounted by a perforated insole made of leather or hide. The mid-sole is arranged within a perimetric edge for connecting the upper to the insole without requiring a toe lasting machine, the heel region and/or the front region and/or the central region contain, below the mid-sole, components made of a felt of natural fibers and covered with a membrane of microporous, transpiring and waterproof material and/or with perforated components made of leather or hide at openings of the edge of a box-like rubber sole that contains the entire assembly. The openings on the edge of the sole are closed all around by the edge so as to avoid interrupting its continuity.

6 Claims, 2 Drawing Sheets

VENTILATED WALKING SHOE

BACKGROUND OF THE INVENTION

1. Field of the Invention

The present invention relates to a ventilated walking shoe.

2. Description of the Prior Art

It is known that conventional walking shoes are constituted by an upper, an insole stitched along its edges to the lower border of the upper, and a sole that is applied by gluing to the insole and to the border of the upper. The structure of ventilated walking shoes differs from the structure of conventional shoes in that the sole is applied by gluing it to the lower border of the upper instead of gluing it to the insole. Italian Patent No. 1,259,154, in the name of the present Applicant, discloses a ventilated shoe of this type. That shoe includes a mid-sole made of natural fibers, which is arranged between a perforated leather insole and the sole. The mid-sole is surrounded by a perimetric edge for connection between the upper and the insole. Between the sole and the mid-sole there are components made of natural fibers, which are accommodated in cavities formed in the bottom of the sole at the heel and/or shank and/or toe and are covered by a layer of microporous membrane. Such ventilated shoe has a component arranged at the shank and faces an opening formed on the edge of the sole, so as to allow expulsion of the perspiration that accumulates in the mid-sole. The microporous membrane that surrounds such component is meant to prevent external moisture from entering the shoe through the sole, accordingly preventing correct evacuation of perspiration through such component.

The drawback noted in that shoe is that it tends to tear and break at the region where the upper and the sole are joined, at the opening that accommodates the component that evacuates the perspiration collected in the mid-sole. The gluing, that in conventional shoes affects the entire edge of the sole and the entire lower border of the upper, is in fact not possible in the described ventilated shoe, because the edge of the sole is interrupted by this opening. Therefore, at this opening the connection between the upper and the sole is provided by this component. The structure of the component is not very strong per se and is also subjected to the deteriorating action of perspiration and of external factors such as humidity. Accordingly, this component tends, after sometime, to unglue from the perimeter of the opening in the sole or from the edge of the upper or from both. The shoe must therefore be repaired but the aesthetic and functional aspect of the shoe are compromised.

SUMMARY OF THE INVENTION

The aim of the present invention is to overcome the cited drawbacks of the prior art.

An object of the invention is to prevent tears or breakages of the shoe at the component that evacuates the vapor collected in the mid-sole.

An object of the invention is to improve a ventilated shoe with an unobtrusive variation in the structure and outward aesthetic appearance.

A further object of the invention is to provide a ventilated shoe that can be produced easily and with normally commercially available materials, using methods commonly employed in the shoemaking field, at low costs, and significantly increases the durability of the shoe.

A further object of the invention is to provide an improvement that can be applied to a wide range of ventilated walking shoes in terms of shapes, styling and size.

This aim and these and other objects that will become better apparent hereinafter are achieved by a ventilated walking shoe as claimed in the appended claims.

The openings are formed at the shank of the shoe, one on each side, have an approximately elliptical shape, and are elongated in the direction of the extension of the edge.

BRIEF DESCRIPTION OF THE DRAWINGS

Further characteristics and advantages of the invention will become better apparent from the detailed description of an embodiment thereof, illustrated only by way of non-limitative example in the two accompanying drawings, wherein.

DESCRIPTION OF THE PREFERRED EMBODIMENTS OF THE INVENTION

Figure 1:
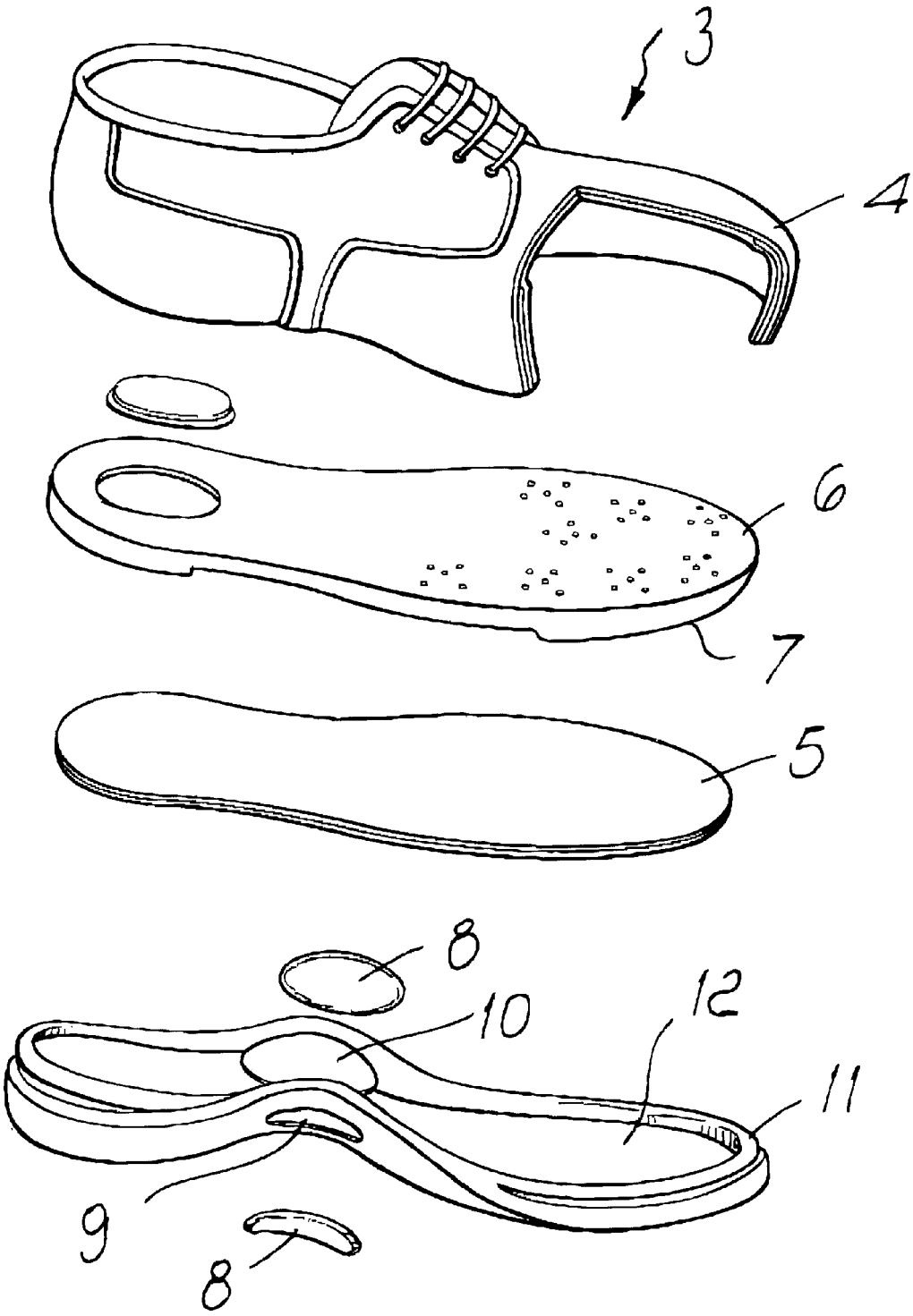
FIG. 1 is an exploded perspective view of a ventilated shoe according to the invention.
Figure 2:
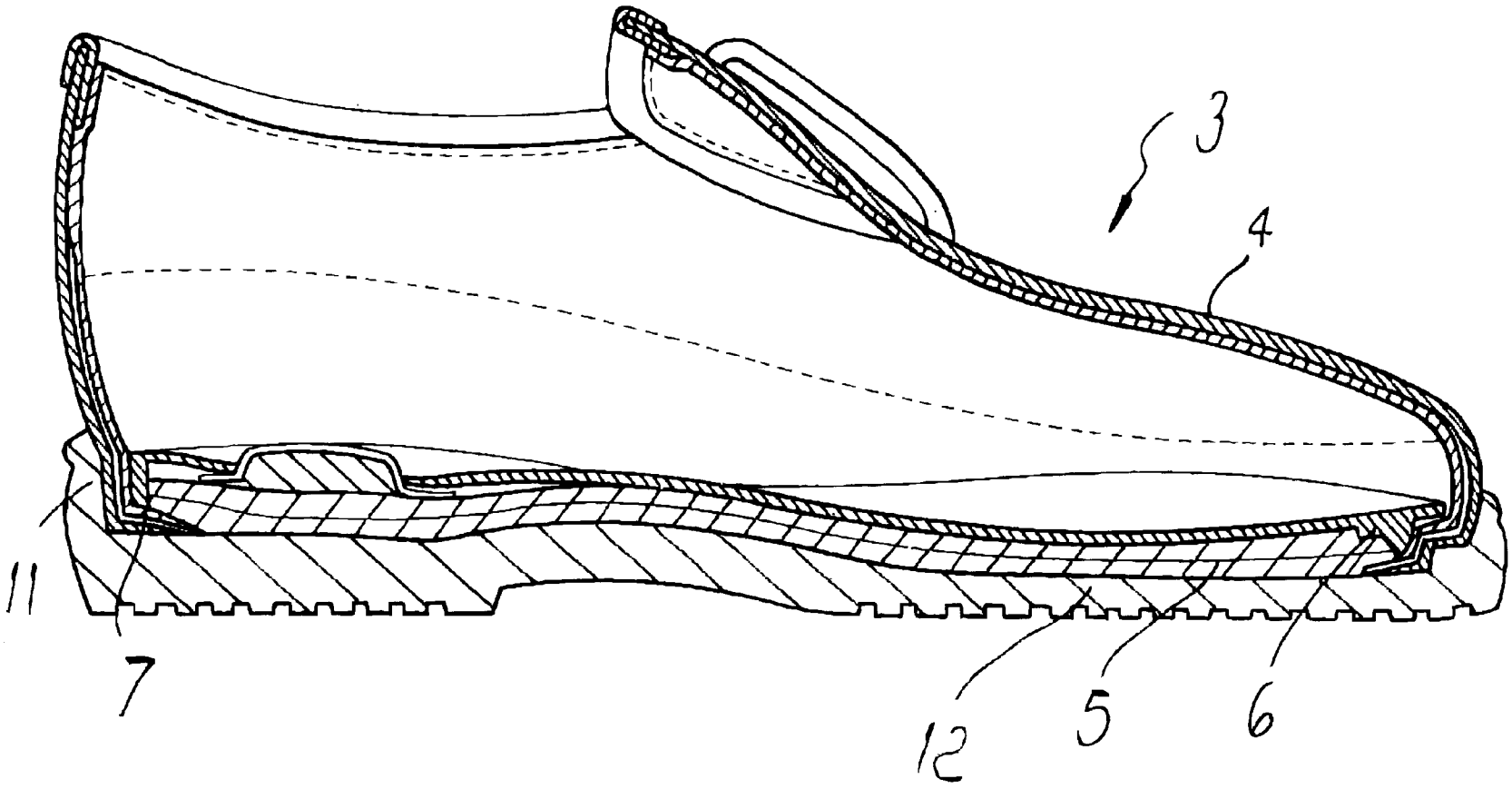
FIG. 2 is a longitudinal sectional view of the shoe of FIG. 1.

With reference to the accompanying figures, a ventilated walking shoe, generally designated by the reference numeral 3, comprises, under an upper 4, a mid-sole 5 that is constituted by a component made of a felt of natural fibers, surmounted by a perforated insole 6 made of leather or hide and surrounded by a perimetric edge 7 that connects the upper 4 to the insole 6.

Below the mid-sole 5, the shoe 3 has components 8, made of a felt of natural fibers and covered with a membrane of microporous, transpiring and waterproof material and/or with perforated components made of leather or hide, which are arranged in the central region at openings 9 and 10 of an edge 11 of a box-like rubber sole 12.

As better seen in FIG. 1, the openings 9 and 10, on the edge 11, are closed all around by the edge 11, so that they do not interrupt its continuity. In this manner it is possible to glue the edge 11 of the sole 12 to the lower border of the upper 4 along the entire width of the edge 11.

Preferably, the openings 9 and 10 are formed at the shank of the shoe 3, one on each side.

The openings 9 and 10 are approximately elliptical. It is nonetheless possible to provide openings 9 and 10 having different shapes according to particular functional or aesthetic requirements.

The openings 9 and 10 are elongated in the direction of the extension of the edge 11. The dimensions of the openings 9 and 10 should of course be such as to accommodate components 8 that are large enough to perform their action of evacuating the vapor enclosed in the mid-sole 5.

The outer surface of the components 8 can be decorated at will, for example in a matching color with respect to the upper 4, so as to produce a pleasant aesthetic effect in the sole 12.

It has been found in practice that the ventilated shoe according to the invention achieves the intended aim and objects, since it allows to provide a shoe that permanently solves the drawback noted in the current art related to ventilated shoes.

In the practical execution, the materials used, the shapes, the dimensions and the constructive details may be different from the ones indicated but technically equivalent thereto without thereby abandoning the juridical scope of the invention.

What is claimed is:

1. A ventilated walking shoe comprising a mid-sole, under the upper; said mid-sole comprising a felt of natural fibers and being surmounted by a perforated insole made of leather or hide, said mid-sole being arranged within a perimetric edge for connecting the upper to the insole without requiring a toe lasting machine, the heel region and/or the front region and/or the central region containing, below said mid-sole, components made of a felt of natural fibers and covered with a membrane of microporous, transpiring and waterproof material and/or with perforated components made of leather or hide at openings of the edge of a box-like rubber sole that contains the entire assembly, wherein said openings on said edge of said sole are closed all around by said edge so as to avoid interrupting its continuity.

2. The shoe according to claim 1, wherein said openings are formed at the shank of said shoe.

3. The shoe according to claim 1, wherein said openings are formed so that there is one on either side of said shoe.

4. The shoe according to claim 1, wherein said openings are approximately elliptical.

5. The shoe according to 1, wherein said openings are elongated in the direction of the extension of said edge.

6. The shoe according to claim 1, wherein said components accommodated in said openings can be decorated at will externally.

* * * * *